US009031487B2

(12) United States Patent
Usui et al.

(10) Patent No.: US 9,031,487 B2
(45) Date of Patent: May 12, 2015

(54) FIXING DEVICE AND IMAGE FORMING APPARATUS INCLUDING THIS FIXING DEVICE

(71) Applicant: KYOCERA Document Solutions Inc., Osaka (JP)

(72) Inventors: Syogo Usui, Osaka (JP); Satoshi Ishii, Osaka (JP); Eiji Tatsumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/094,530

(22) Filed: Dec. 2, 2013

(65) Prior Publication Data

US 2014/0153985 A1 Jun. 5, 2014

(30) Foreign Application Priority Data

Dec. 3, 2012 (JP) ..... 2012-263990

(51) Int. Cl.
*G03G 15/20* (2006.01)

(52) U.S. Cl.
CPC ..... *G03G 15/2053* (2013.01); *G03G 15/2042* (2013.01)

(58) Field of Classification Search
CPC ..... G03G 15/2017; G03G 15/2019; G03G 2215/021
See application file for complete search history.

(56) References Cited

U.S. PATENT DOCUMENTS

| | | | | |
|---|---|---|---|---|
| 3,709,360 | A * | 1/1973 | Baker | 209/215 |
| 3,901,379 | A * | 8/1975 | Bruhm | 198/831 |
| 7,369,804 | B2 * | 5/2008 | Yasuda et al. | 399/330 |

FOREIGN PATENT DOCUMENTS

| | | | |
|---|---|---|---|
| JP | 10-074009 | A | 3/1998 |
| JP | 2005-056595 | A | 3/2005 |
| JP | 2006-011294 | A | 1/2006 |
| JP | 2010113004 | A * | 5/2010 |

OTHER PUBLICATIONS

JP_2006011294_A_T Machine Translation.*
JP_2010113004_A_T Machine Translation.*

* cited by examiner

*Primary Examiner* — Clayton E Laballe
*Assistant Examiner* — Victor Verbitsky
(74) *Attorney, Agent, or Firm* — Studebaker & Brackett PC

(57) ABSTRACT

A fixing device includes a heating member pressed by a pressing member to form a nip part, an excitation coil generating a magnetic flux induction-heating the heating member, a magnetic core and a magnetism shielding member. The magnetic core is located opposite to the heating member across the excitation coil and provides a magnetic path passing through the excitation coil and heating member. The magnetism shielding member partially shields the magnetic path and includes a rotatable belt member allowing the magnetic flux to pass through, and a magnetism shielding layer arranged on a surface of the belt member. In the magnetism shielding layer, gap parts extending in a width direction of the belt member are arranged along a circumference direction of the belt member. When the magnetism shielding member is located to shield the magnetic path, inner wall faces of the gap part are brought into contact with each other.

12 Claims, 20 Drawing Sheets

FIXING DEVICE AND IMAGE FORMING APPARATUS INCLUDING THIS FIXING DEVICE

INCORPORATION BY REFERENCE

This application is based on and claims the benefit of priority from Japanese Patent application No. 2012-263990 filed on Dec. 3, 2012, the entire contents of which are incorporated herein by reference.

BACKGROUND

The present disclosure relates to a fixing device and an image forming apparatus including this fixing device, particularly an electromagnetic induction heating type fixing device and an image forming apparatus including this fixing device.

An electromagnetic induction heating type fixing device generates an eddy current in an induction heat generation layer provided in a heating member by a magnetic flux generated in an excitation coil. The fixing device then generates heat in the induction heat generation layer by Joule heat generated by the eddy current to heat the heating member to a predetermined fixing temperature. In this type of the fixing device, since a heat capacity of the induction heat generation layer can be reduced, a warm-up time required for activating the device can be shortened and heat exchanging efficiency can be enhanced. However, when a size of a sheet to be used in fixing process is small, in a sheet passing region in the heating member on which the sheet passes, heat of a surface of the sheet passing region is absorbed by the sheet and a temperature of the sheet passing region becomes low. On the other hand, a sheet not-passing region in the heating member on which the sheet does not pass becomes a high temperature state. In particular, when the sheets are continuously made passed, if the sheet passing region in the heating member remains in the fixing temperature, a temperature of the sheet not-passing region of the heating member is excessively increased, thereby causing failures that temperatures of the heating member and excitation coil exceed a heat resistance limit and that such components are thermal-damaged.

By contrast, some fixing devices solving the above-mentioned failures may be proposed. For example, there is a fixing device provided with a metal sleeve (a heating member), an induction coil (an excitation coil) generating a magnetic flux induction-heating the metal sleeve and a magnetic flux shielding means (a magnetic flux shielding member) inserted between the metal sleeve and induction coil. In this fixing device, the magnetic flux shielding means is configured to move along an axis direction of the metal sleeve. When a small-sized sheet is used in the fixing process, the magnetic flux shielding means is inserted from an end part of the metal sleeve in the axis direction between the metal sleeve and induction coil. According to this, the magnetic flux affecting the sheet not-passing region is cut off and heat generation of the sheet not-passing region by the metal sleeve is restrained.

There is another fixing device in which an excitation coil and a magnetic core are located inside a fixing roller (a heating member) and a magnetic flux shielding member (a magnetism shielding member) enclosing the excitation coil and magnetic core so as to pass between the excitation coil or the magnetic core and the fixing roller. The magnetic flux shielding member includes a flexible base layer (a belt member) and a metal shielding layer arranged in a predetermined area of the base layer and is stretched between a drive shaft and a tension shaft. In this other fixing device, when the small-sized sheet is used in the fixing process, the magnetic flux shielding member is rotated in a circumference direction, and accordingly, the shielding layer is inserted between the fixing roller and excitation coil. According to this, the magnetic flux affecting the sheet not-passing region is cut off and heat generation of the sheet not-passing region by the fixing roller is restrained.

There is a further fixing device provided with a coil part (an excitation coil) generating a magnetic flux induction-heating a fixing belt (a heating member), a magnetic core and a shielding member (a magnetism shielding member) enclosing the excitation coil and magnetic core so as to pass between the excitation coil and fixing belt and shielding the magnetic flux. The shielding member is an endless belt-like member made from a thin film metal and is stretched by a supporting shaft. In the shielding member, an opening part and a covered part (a portion except for the opening part) shielding the magnetic flux are formed. In this further fixing device, when the magnetic flux is shielded, the shielding member is rotated in a circumference direction, and accordingly, the covered part is inserted between the fixing belt and excitation coil. According to this, heat generation of the fixing belt is restrained.

SUMMARY

In accordance with an embodiment of the present disclosure, a fixing device includes a pressing member, a heating member, an excitation coil, a magnetic core and a magnetism shielding member. The heating member is pressed into contact with the pressing member to form a nip part. The excitation coil is configured to generate a magnetic flux induction-heating the heating member. The magnetic core is located at an opposite side from the heating member across the excitation coil and configured to provide a magnetic path passing through the excitation coil and heating member. The magnetism shielding member is arranged so as to shield a part of the magnetic path, and configured to include a flexible endless belt member driven to rotate and allowing the magnetic flux to pass through, and a non-magnetic metal magnetism shielding layer arranged at a predetermined area in a surface of the belt member. The magnetism shielding member is configured so that, in the magnetism shielding layer, gap parts extending in a width direction of the belt member are arranged at every predetermined pitch along a circumference direction of the belt member. In a situation of the magnetism shielding member located at a position in which the magnetic path is shielded, at least portions of inner wall faces of the gap part of the magnetism shielding layer are brought into contact with each other.

In accordance with an embodiment of the present disclosure, an image forming apparatus includes an image forming part and a fixing device. The fixing device includes a pressing member, a heating member, an excitation coil, a magnetic core and a magnetism shielding member. The heating member is pressed into contact with the pressing member to form a nip part. The excitation coil is configured to generate a magnetic flux induction-heating the heating member. The magnetic core is located at an opposite side from the heating member across the excitation coil and configured to provide a magnetic path passing through the excitation coil and heating member. The magnetism shielding member is arranged so as to shield a part of the magnetic path, and configured to include a flexible endless belt member driven to rotate and allowing the magnetic flux to pass through, and a non-magnetic metal magnetism shielding layer arranged at a predetermined area in a surface of the belt member. The magnetism shielding member is configured so that, in the magnetism shielding layer, gap parts extending in a width direction of the belt member are arranged at every predetermined pitch along a circumference direction of the belt member. In a situation of the magnetism shielding member located at a position in which the magnetic path is shielded, at least portions of inner wall faces of the gap part of the magnetism shielding layer are brought into contact with each other.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
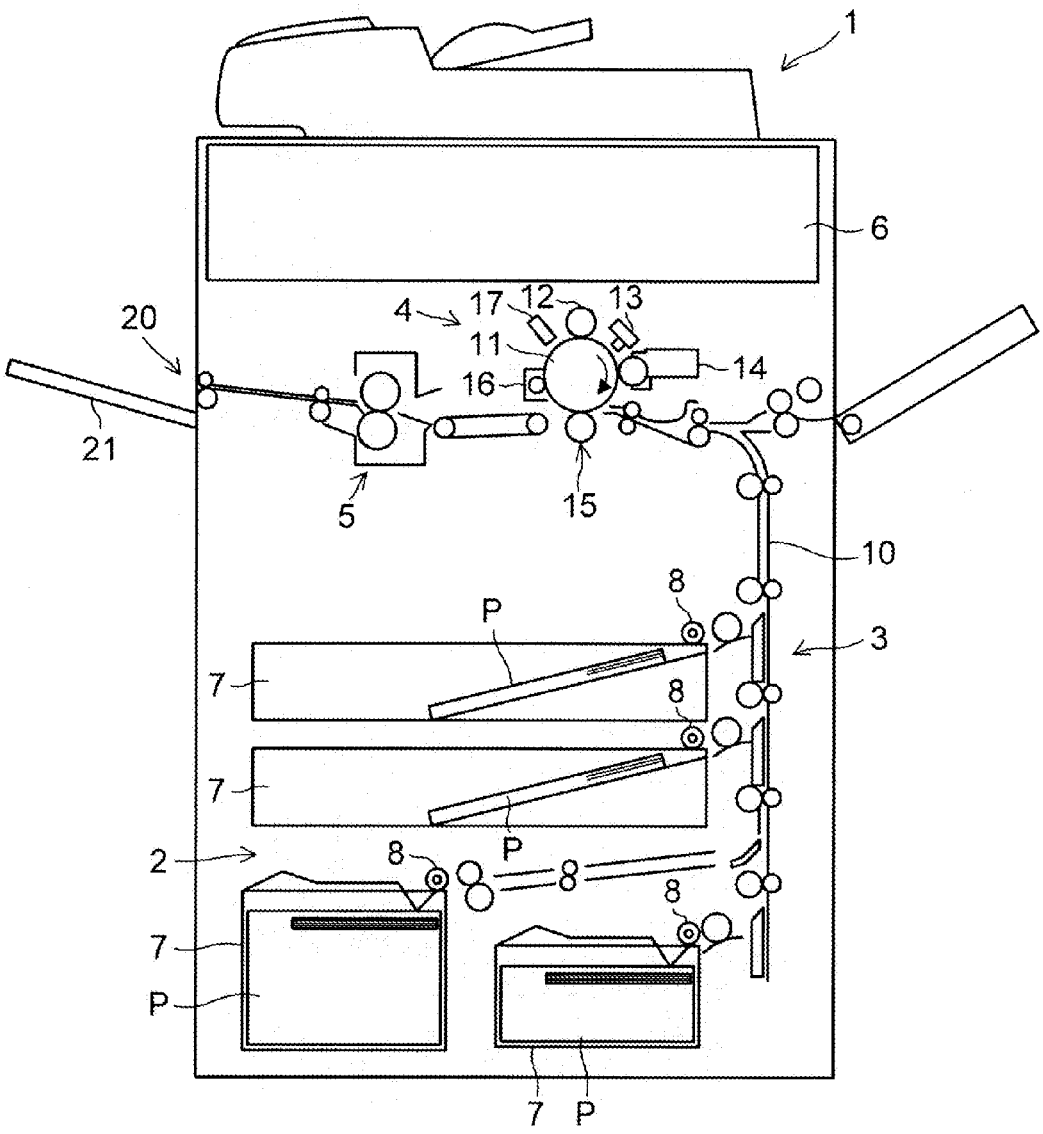
FIG. 1 is a sectional view schematically showing an entire structure of an image forming apparatus including a fixing device according to a first embodiment of the present disclosure.

In the following, embodiments of the present disclosure will be described with reference to the drawings.

With reference to FIGS. 1-10, an image forming apparatus 1 according to a first embodiment of the present disclosure will be described. The image forming apparatus 1 includes a sheet feeding part 2, a sheet conveying part 3, an image forming part 4, a fixing device 5 and an image reading part 6. The sheet feeding part 2 is arranged in a lower part of the image forming apparatus 1 and the sheet conveying part 3 is arranged at the side of sheet feeding part 2. The image forming part 4 is arranged above the sheet conveying part 3 and the fixing device 5 is arranged at a sheet ejection side from the image forming part 4. The image reading part 6 is arranged above the image forming part 4 and fixing device 5.

The sheet feeding part 2 includes a plurality of sheet feeding cartridges 7 storing a sheet P as a recording medium. In the sheet feeding part 2, by rotating a sheet feeding roller 8, the sheet P is delivered one by one from the sheet feeding cartridge 7 selected out of the plurality of sheet feeding cartridges 7 to the sheet conveying part 3.

The sheet P delivered to the sheet conveying part 3 passes through a sheet conveying path 10 arranged in the sheet conveying part 3 and is conveyed to the image forming part 4. The image forming part 4 is configured to form a toner image on the sheet P by an electrographic process. The image forming part 4 includes a photosensitive body 11 supported rotatably in a direction indicated by an arrow in FIG. 1, and includes a charging part 12, an exposing part 13, a developing part 14, a transferring part 15, a cleaning part 16 and a static eliminating part 17 around the photosensitive body 11 along the rotating direction of the photosensitive body 11.

The charging part 12 includes a charging roller to which high voltage is applied. When the charging roller coming into contact with a surface of the photosensitive body 11 applies a predetermined voltage to the surface of the photosensitive body 11, the surface of the photosensitive body 11 is uniformly electric-charged. Subsequently, when a light based on image data of a document read by the image reading part 6 is irradiated from the exposing part 13 to the photosensitive body 11, surface potential of the photosensitive body 11 is selectively attenuated and an electrostatic latent image is formed on the surface of the photosensitive body 11.

The developing part 14 develops the electrostatic latent image on the surface of the photosensitive body 11 by toner (developer) to form the toner image on the surface of the photosensitive body 11. The transferring part 15 transfers the toner image on the sheet P fed between the photosensitive body 11 and transferring part 15.

The sheet P with the transferred toner image is conveyed to the fixing device 5 located at a downstream side in a sheet conveying direction from the image forming part 4. The fixing device 5 heats and presses the sheet P so that the toner image is melted and fixed on the sheet P. Subsequently, the sheet P with the fixed toner image is ejected onto an ejection tray 21 by a pair of ejecting rollers 20.

After the transferring part 15 transfers the toner image on the sheet P, the cleaning part 16 removes the toner remaining on the surface of the photosensitive body 11 and the static eliminating part 17 removes electrical charge remaining on the surface of the photosensitive body 11. Subsequently, the photosensitive body 11 is electric-charged by the charging part 12 again and the image forming is carried out similarly to the above-mentioned way.

Figure 2:
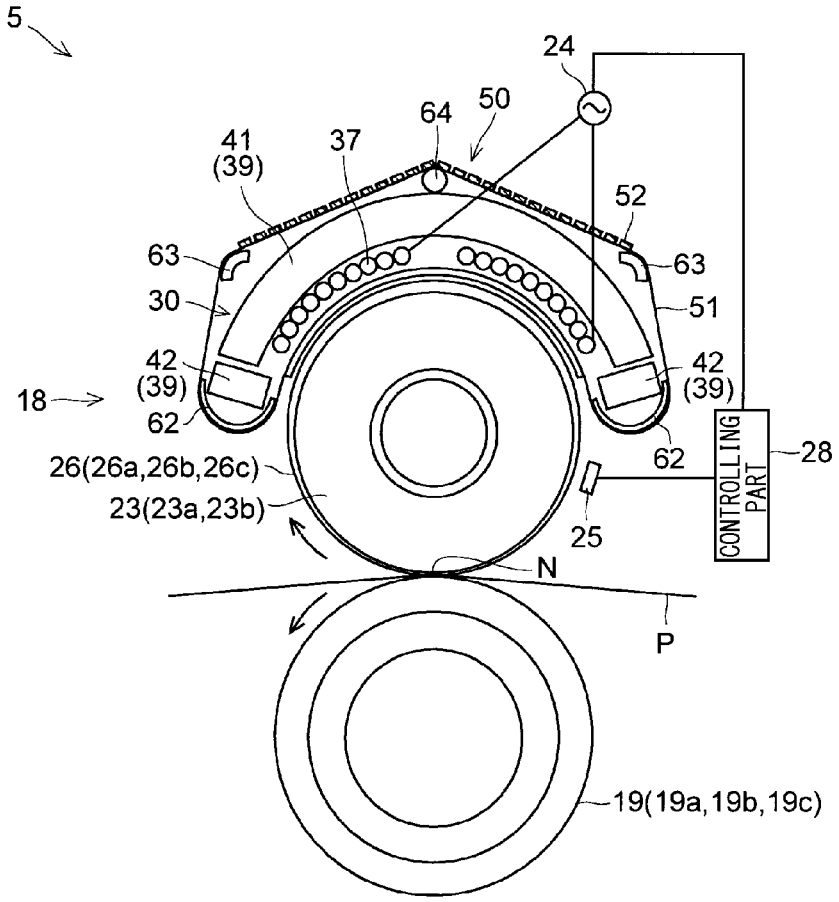
FIG. 2 is a sectional view schematically showing a structure of the fixing device according to the first embodiment of the present disclosure.

Next, a structure of the fixing device 5 will be described in detail. The fixing device 5 is configured to apply an electromagnetic induction heating manner and, as shown in FIG. 2, includes a heating part 18 and a pressing roller 19 as a pressing member. The heating part 18 includes an endless heating belt 26 as a heating member, a fixing roller 23 arranged at an internal circumference's side of the heating belt 26 and an induction heating part 30 arranged facing to the fixing roller 23 at an external circumference's side of the heating belt 26. The fixing device 5 further includes a power source 24 connected to the induction heating part 30, a thermistor 25 detecting temperature of the external circumference face of the heating belt 26 and a controlling part 28 controlling current supplied from the power source 24 to a excitation coil 37 mentioned below on the basis of the temperature detected by the thermistor 25.

The pressing roller 19 is driven by a drive source (not shown), such as a motor, to rotate in a direction indicated by an arrow in FIG. 2 and pressed to the fixing roller 23 so that the center of the pressing roller 19 is directed toward the center of the fixing roller 23. According to this, the pressing roller 19 and fixing roller 23 are pressured to each other via the heating belt 26. In a pressuring state of the pressing roller 19 and fixing roller 23, by the rotation drive of the pressing roller 19, the heating belt 26 and fixing roller 23 is rotated in the direction indicated by the arrow in FIG. 2. In a portion at which the heating belt 26 and pressing roller 19 come into contact with each other while rotating in respective opposite directions to each other, a nip part N is formed. In this nip part N, the sheet P is nipped and the nipped sheet P is heated and pressed, and accordingly, the toner in powder state on the sheet P is melted and fixed.

The pressing roller 19 includes a cylinder-formed core metal 19*a*, an elastic layer 19*b* formed on the core metal 19*a* and a release layer 19*c* covering a surface of the elastic layer 19*b*. For example, the core metal 19*a* is formed by an external diameter of 20 mm, a thickness of 4 mm and a length of 370 mm in a width direction orthogonal to the conveying direction of the sheet P. On the core metal 19*a* made from aluminum, the elastic layer 19*b* made from silicone rubber with a thickness of 4 mm is arranged and, on the elastic layer 19*b*, the release layer 19*c* composed of fluororesin tube or the like with a thickness of 30 μm is arranged.

The fixing roller 23 comes into contact with the internal circumference face of the heating belt 26 so as to rotate together with the heating belt 26. For example, the fixing roller 23 is formed by an external diameter 22 mm and a length in a width direction of 370 mm and have, on a core metal 23*a* made from aluminum with a thickness of 2 mm, an elastic layer 23*b* made from silicone rubber with a thickness 8 mm.

The heating belt 26 is an endless heat resistance belt, for example, with an internal diameter of 40 mm and a length in a width direction of 360 mm in a state of being transformed to a cylinder shape, and can be transformed to various shapes except for the cylinder. For example, the heating belt 26 is configured by laminating, in order from the internal circumference side, an induction heat generation layer 26*a* made from electroformed nickel with a thickness of 40 μm, an elastic layer 26*b* made from silicone rubber or the like with a thickness 300 μm and a release layer 26*c* composed of fluororesin tube to enhance releasability when not-fixed toner image is melted and fixed in the nip part N.

The induction heating part 30 includes the excitation coil 37 and a magnetic core 39 located at an opposite side from the heating belt 26 across the excitation coil 37 and generates heat to the heating belt by electromagnetic induction. The induction heating part 30 extends in a longitudinal direction of the heating belt 26 (in front and back directions in a paper of FIG. 2, in a width direction of the heating belt 26) and is arranged facing to the heating belt 26 so as to enclose roughly half of the external circumference of the fixing roller 23.

In the excitation coil 37, a litz wire is wound several times in a loop form along the width direction of the heating belt 26 and attached to a coil fastened member (not shown) made from resin. The excitation coil 37 is connected to the power source 24 to generate an alternating current magnetic flux by high frequency current supplied from the power source 24. The magnetic flux from the excitation coil 37 passes through the magnetic core 39, and is induced in a parallel direction to a paper of FIG. 2 to pass along the induction heat generation layer 26*a* of the heating belt 26. When alternating current strength of the magnetic flux passing through the induction heat generation layer 26*a* is varied, an eddy current is generated in the induction heat generation layer 26*a*. If the eddy current is flowed in the induction heat generation layer 26*a*, Joule heat is generated by electric resistance of the induction heat generation layer 26*a*, thereby generating heat to the heating belt 26.

When the heating belt 26 is heated by the induction heating part 30 and temperature of the heating belt 26 is increased by a predetermined temperature, the sheet P nipped by the nip part N is heated and pressed by the pressing roller 19, and accordingly, the toner in powder state on the sheet P is melted and fixed on the sheet P. Thus, since the heating belt 26 is composed of a thin material with excellent thermal conductivity and has small heat capacity, the fixing device 5 becomes an activation state for a short time and the image forming is quickly started.

Figure 3:
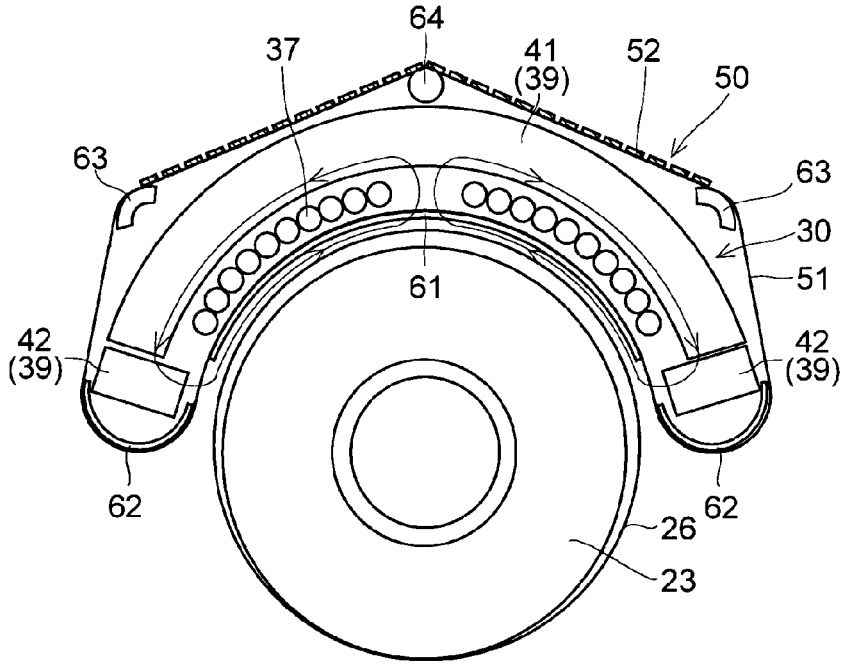
FIG. 3 is a sectional view schematically showing a structure of an induction heating part and its periphery in the fixing device according to the first embodiment of the present disclosure.

A detailed structure of the induction heating part is illustrated in FIG. 3. As shown in FIG. 3, the induction heating part 30 includes the excitation coil 37 and magnetic core 39 mentioned above and the magnetic core 39 is composed of a first magnetic core 41 and a second magnetic core 42. Moreover, the induction heating part 30 is provided with a magnetism shielding member 50 enclosing the excitation coil 37 and magnetic core 39 so as to pass between the excitation coil 37 and heating belt 26.

To the excitation coil 37, the litz wire covered by a welded layer is applied. The litz wire is wound in the loop form around the longitudinal direction (front and back directions in a paper of FIG. 3) in an arc-shaped state in sectional view adapted along an attached face (an upper face) of the coil fastened member (not shown). In addition, the litz wire is heated to melt the welded layer, and then, cooled to form in a given shape (a loop shape). The excitation coil 37 solidified in the given shape is attached to the coil fastened member by silicone adhesive or the like.

The first magnetic core 41 is formed in an arc-shape in sectional view by Mn—Zn alloy or the like based ferrite having high permeability and is formed, for example, by a width (a length in the width direction of the heating belt 26) of 12 mm. A plural number (e.g. the number of thirteen) of the first magnetic cores 41 are located at a predetermined interval in the width direction of the heating belt 26. The first magnetic core 41 is attached to a supporting member (not shown) provided together with the coil fastened member.

The second magnetic core 42 is formed in a rectangular parallelepiped shape by Mn—Zn alloy or the like based ferrite having high permeability and is formed, for example, by a length (a length in the width direction of the heating belt 26) of 55 mm, a width of 15 mm and a thickness of 5 mm. Seven second magnetic cores 42 (the total length of 385 mm) are located at each of both sides of the fixing roller 23 so that the neighboring side faces come into contact with each other in the width direction of the heating belt 26, and are attached to the coil fastened member.

Therefore, when the first magnetic cores 41 and second magnetic cores 42 are respectively attached at predetermined positions of the supporting member and coil fastened member, the first magnetic cores 41 and second magnetic cores 42 enclose the outside of the excitation coil 37. Then, when the excitation coil 37 generates the magnetic flux by the high frequency current, the first magnetic cores 41 and second magnetic cores 42 provide magnetic paths in respective predetermined directions.

The magnetism shielding member 50 includes a belt member 51 driven to rotate around the excitation coil 37 and magnetic core 39, and magnetism shielding layers 52 arranged at predetermined areas in a surface of the belt member 51.

The belt member 51 is an endless belt, for example, with an internal diameter of 50 mm and a length in a width direction of 380 mm in a state of being transformed to a cylinder shape, and can be transformed to various shapes except for the cylinder. The belt member 51 is suspended by an arc-shaped inside guide 61, guides 62, a tension member 63 and a drive roller 64. The inside guide 61 is located between the heating belt 26 and excitation coil 37. The guides 62 are located adjacent to the second magnetic cores 42. The tension member 63 and drive roller 64 are located above the first magnetic cores 41. The belt member 51 is composed of a flexible magnetic sheet (e.g. a thickness of 50 μm) made from heat resistance resin, such as polyimide resin, containing ferrite powder, and is formed in an endless shape having a length equal to or more than the length in the width direction of the heating belt 26. When the excitation coil 37 generates the magnetic flux by the high frequency current, the magnetic flux passes through the belt member 51 containing the ferrite powder. The drive roller 64 is connected to the drive source (not shown), such as the motor, and is rotated by rotation drive of the motor. Then, the belt member 51 is rotated by rotation drive of the drive roller 64.

The magnetism shielding layer 52 is formed with a length in a circumference direction of approximately 42 mm and a length in a width direction of 50 mm respectively with respect to the belt member 51. The magnetism shielding layer 52 is made from non-magnetic material, such as copper or aluminum, with excellent electric conductivity and formed in a sheet-like shape (e.g. a thickness of 500 μm). The magnetism shielding layer 52 generates a reverse magnetic flux by an induced current caused by the passage of the magnetic flux perpendicular to a surface of magnetism shielding layer 52, because of having non-magnetism, and suppresses and shields the magnetic flux passing perpendicularly to the surface. The magnetism shielding layer 52 can restrain Joule heat generated by the induced current and effectively shield the magnetic flux, because of having low electric resistance. The magnetism shielding layers 52 are located at parts in a wound direction (a circumference direction) of the belt member 51 and located at both sides in the width direction of the belt member 51.

Figure 4:
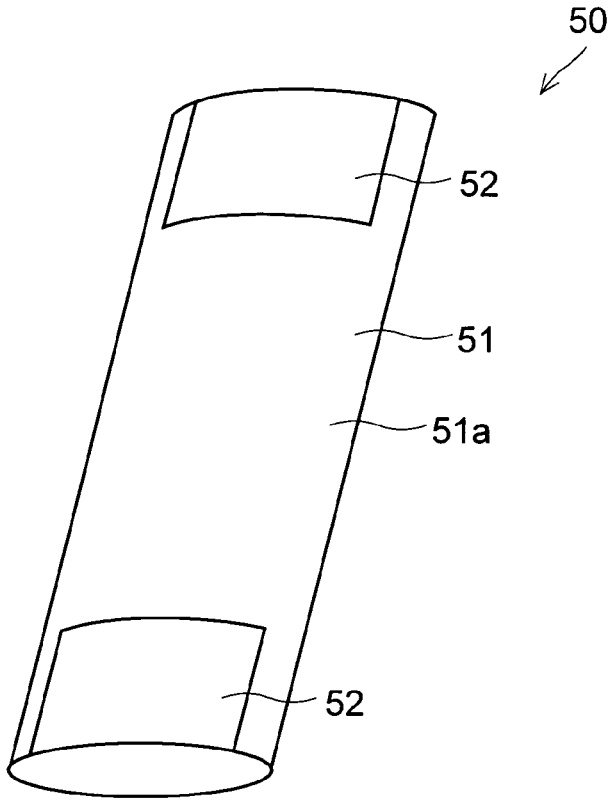
FIG. 4 is a perspective view schematically showing a structure of a magnetism shielding member in the fixing device according to the first embodiment of the present disclosure.
Figure 5:
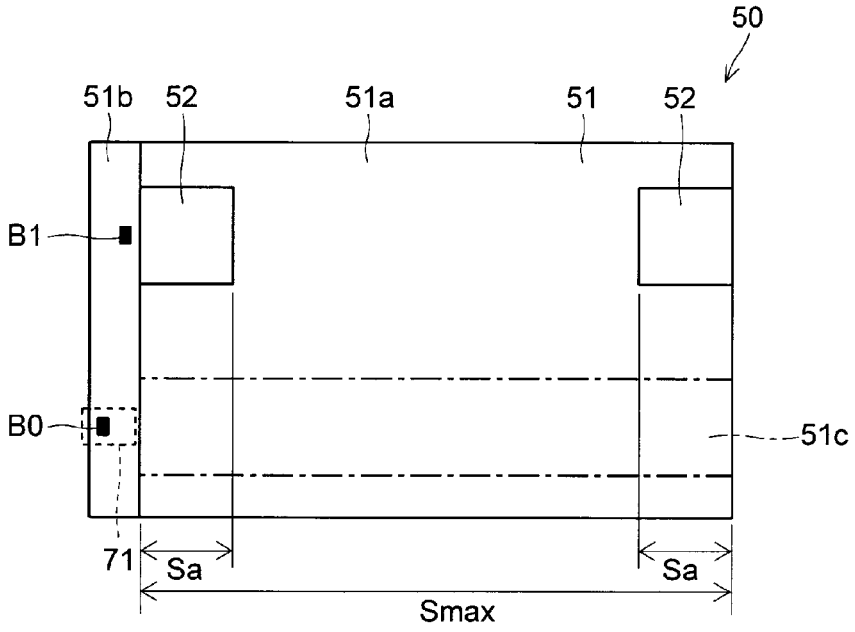
FIG. 5 is a plan view schematically showing the magnetism shielding member in a developed state in the fixing device according to the first embodiment of the present disclosure.

FIGS. 4 and 5 illustrate a detailed structure of the belt member 51. In FIG. 4, a detected part 51*b* mentioned below is omitted. The belt member 51 includes a magnetic part 51*a* containing the ferrite powder mentioned above and on a surface of the magnetic part 51*a*, the magnetism shielding layers 52 are adhered. The magnetism shielding layers 52 are located at both sides in a width direction of the magnetic part 51*a*. The magnetism shielding layers 52 may be arranged at an area where the magnetic part 51*a* is not provided, without being arranged on the surface of magnetic part 51*a*.

As shown in FIG. 5, the belt member 51 includes the detected part 51*b* detecting a rotation position of the belt member 51 in addition to the magnetic part 51*a*.

The magnetic part 51*a* has a width equal to or more than a maximum sheet passing region Smax of the sheet P with a maximum width inserted into the nip part N. The magnetism shielding layer 52 has a length in the circumference direction of the belt member 51 (in upward and downward directions in FIG. 5) approximately equal to a length of an arrangement area (refer to FIG. 3) of the excitation coil 37. When the belt member 51 is rotated by the rotation of the drive roller 64 (refer to FIG. 3) and the magnetism shielding layers 52 are inserted between the excitation coil 37 and heating belt 26, the magnetic path between the magnetic core 39 and heating belt 26 (refer to FIG. 3) is cut off by the magnetism shielding layers 52.

The magnetism shielding layer 52 has a width corresponding to a sheet not-passing region Sa of the heating belt 26 caused outside a first sheet P having a smaller width than the sheet P with the maximum width. When the magnetism shielding layers 52 are inserted between the excitation coil 37 and heating belt 26, the magnetic path between the magnetic core 39 and heating belt 26 is provided in a portion corresponding to the maximum sheet passing region Smax except for the sheet not-passing region Sa, but is cut off in another portion corresponding to the sheet not-passing region Sa by the magnetism shielding layers 52.

In a position close to the magnetism shielding layer 52 (a lower side of the magnetism shielding layer 52 in FIG. 5, a part indicated by a chain line), a magnetic region 51*c* is arranged. The magnetic region 51*c* is provided by a part of the magnetic part 51*a*. In the magnetic region 51*c*, the magnetism shielding layer 52 is not provided throughout the maximum sheet passing region Smax. When the magnetic region 51*c* is inserted between the excitation coil 37 and heating belt 26, the magnetic path between the magnetic core 39 and heating belt 26 is provided throughout the maximum sheet passing region Smax.

At one end side of the belt member 51, the detected part 51*b* is arranged. At the peripheral (e.g. a downward side) of the belt member 51, in a position facing to the detected part 51*b*, a detecting sensor (a position detecting member) 71 is arranged. The detected part 51*b* includes reflection faces B0 and B1 respectively corresponding to the magnetic region 51*c* and magnetism shielding layer 52. The detecting sensor 71 receives a reflected light from one reflection face of the reflection faces B0 and B1, and accordingly, detects which one of the magnetic region 51*c* and magnetism shielding layer 52 is positioned between the excitation coil 37 and heating belt 26.

Concretely, the reflection faces B0 and B1 are located adjacent to the magnetic region 51*c* and magnetism shielding layer 52 and respectively located corresponding to the magnetic region 51*c* and magnetism shielding layer 52 in the upward and downward directions in FIG. 5. The reflection faces B0 and B1 are formed in a rectangular pattern arranged shifted from each other in the width direction of the belt member 51 (left and right directions in FIG. 5) and formed on the surface of the belt member 51 by aluminum coating or the like. The detecting sensor 71 is attached to a supporting member (not shown) and composed of a light projecting part, such as a light emitting diode, and a light receiving part receiving the reflected light indicating each pattern from the reflection face B0 or B1 against a light irradiated from the light projecting part (in the present embodiment, two units composed of the light projecting part and light receiving part are arranged). For example, when the reflection face B0 is positioned at a position facing to the detecting sensor 71, the detecting sensor 71 outputs a signal according to the pattern of the reflection face B0. Alternatively, when the reflection face B1 is positioned at a position facing to the detecting sensor 71, the detecting sensor 71 outputs a signal according to the pattern of the reflection face B1. Thus, because the detecting sensor 71 outputs the signal according to the reflection face B0 or B1, it is possible to detect which one of the magnetic region 51*c* and magnetism shielding layer 52 is positioned between the excitation coil 37 and heating belt 26. In a case of arranging several types of magnetism shielding layers on the magnetism shielding member 50, the reflection faces as many as the magnetic regions and magnetism shielding layers may be provided. Alternatively, several reflection faces may be combined, and accordingly, the reflection pattern as many as the magnetic regions and magnetism shielding layers may be provided.

As shown in FIG. 3, when the sheet P with the maximum width is used in fixing process, the magnetic region 51*c* is inserted and held between the excitation coil 37 and heating belt 26. In such a case, in the whole area in the width direction of the sheet P, the magnetic flux generated by the excitation coil 37 passes through the first magnetic core 41, second magnetic core 42, magnetic part 51*a* of the belt member 51 (the magnetic region 51*c* in FIG. 5), heating belt 26 and magnetic part 51*a* of the belt member 51, as indicated by an arrow in FIG. 3, to provide the magnetic path extending to the first magnetic core 41. According to this, the eddy current is generated in the induction heat generation layer 26*a* of the heating belt 26 (refer to FIG. 2) and the Joule heat is generated in the induction heat generation layer 26*a* by the electric resistance of the induction heat generation layer 26*a*, and therefore, the heating belt 26 is excellently heated in the maximum sheet passing region Smax (refer to FIG. 5).

Figure 6:
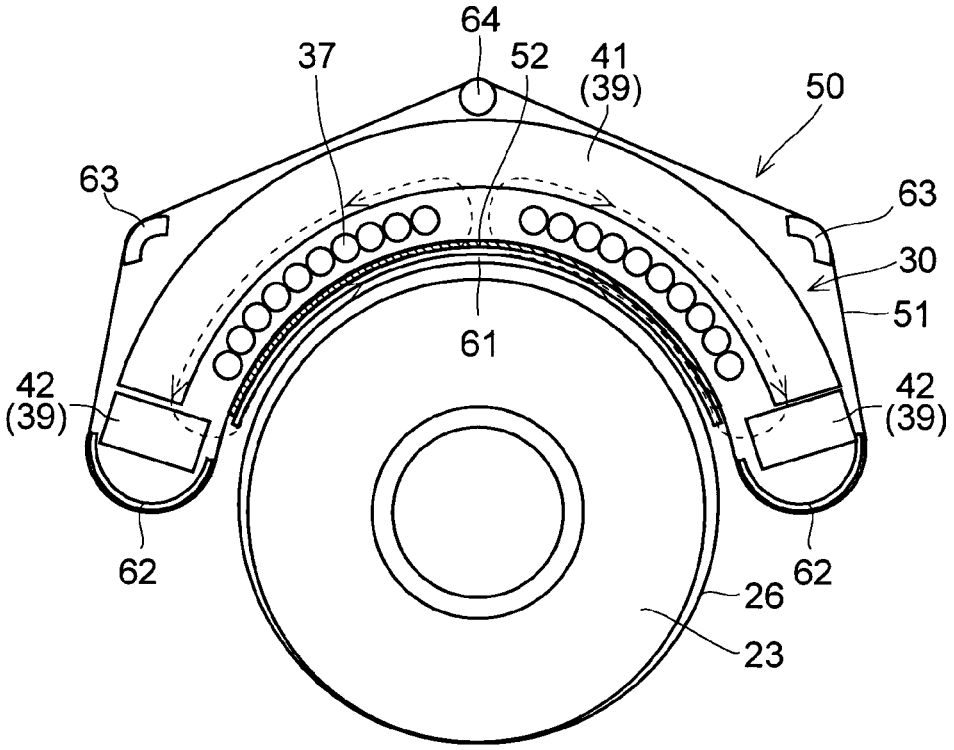
FIG. 6 is a sectional view schematically showing a structure of the induction heating part and its periphery in a situation, in which a magnetic path of a sheet not-passing region is cut off, in the fixing device according to the first embodiment of the present disclosure.

On the other hand, when the sheet P with the small width is used in fixing process, as shown in FIG. 6, for example, the sheet P is selected by an operational panel (not shown), and then, the drive roller 64 is driven to rotate and the belt member 51 is rotated by the rotation of the drive roller 64. When the detecting sensor 71 (refer to FIG. 5) receives the reflection light from the reflection face B1 (refer to FIG. 5) of the belt member 51 corresponding to the sheet P, the drive roller 64 stops rotating and the magnetism shielding layers 52 of the magnetism shielding member 50 are inserted between the excitation coil 37 and heating belt 26 and stops.

In such a case, in the sheet passing region of the heating belt 26, the magnetic flux generated by the excitation coil 37 passes through the first magnetic core 41, second magnetic core 42, magnetic part 51*a* of the belt member 51 (the magnetic region 51*c* in FIG. 5), heating belt 26 and magnetic part 51*a* of the belt member 51, as indicated by a broken line arrow in FIG. 6, to provide the magnetic path extending to the first magnetic core 41. According to this, the eddy current is generated in the induction heat generation layer 26*a* of the heating belt 26 (refer to FIG. 2) and the Joule heat is generated in the induction heat generation layer 26*a* by the electric resistance of the induction heat generation layer 26*a*, and therefore, the heating belt 26 is excellently heated in the sheet passing region (refer to FIG. 5). On the other hand, in the sheet not-passing region of the heating belt 26, a path of the magnetic flux generated by the excitation coil 37 is cut off between the heating belt 26 and magnetic core 39 by the magnetism shielding layers 52 of the magnetism shielding member 50, and generation of the heat in the sheet not-passing region of the heating belt 26 is restrained.

Figure 7:
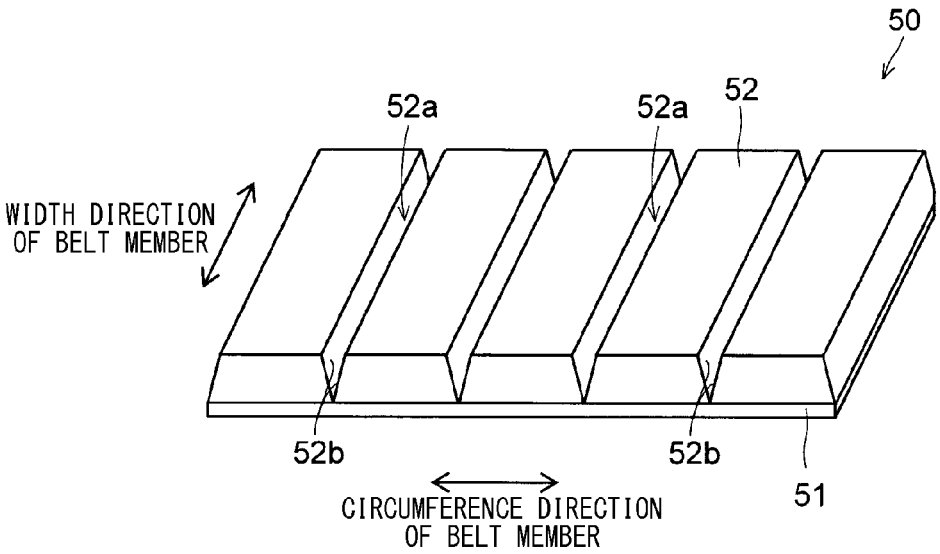
FIG. 7 is an enlarged perspective view schematically showing a structure of a magnetism shielding layer of the magnetism shielding member used in the fixing device according to the first embodiment of the present disclosure.

In the magnetism shielding layer 52, as shown in FIG. 7, gap parts 52*a* extending in the width direction of the belt member 51 (a direction intersecting (orthogonal to) the circumference direction) are arranged at every predetermined pitch (e.g. approximately 5 mm) along the circumference direction of the belt member 51. According to this, it is possible to facilitate a bend of the magnetism shielding layer 52 in the circumference direction of the belt member 51. In the present embodiment, the gap part 52*a* is formed in a V-shaped sectional profile. That is, inner wall faces 52*b* of the gap part 52*a* are formed in inclination faces inclined against the surface of the belt member 51. The inner wall faces 52*b* are formed to have respective portions farthest from the belt member 51 arranged at an interval, for example, of 0.5 mm. The gap parts 52*a* are formed at the same time as forming of the magnetism shielding layer 52 by etching a layer of copper, aluminum or the like adhered on the belt member 51.

Figure 8:
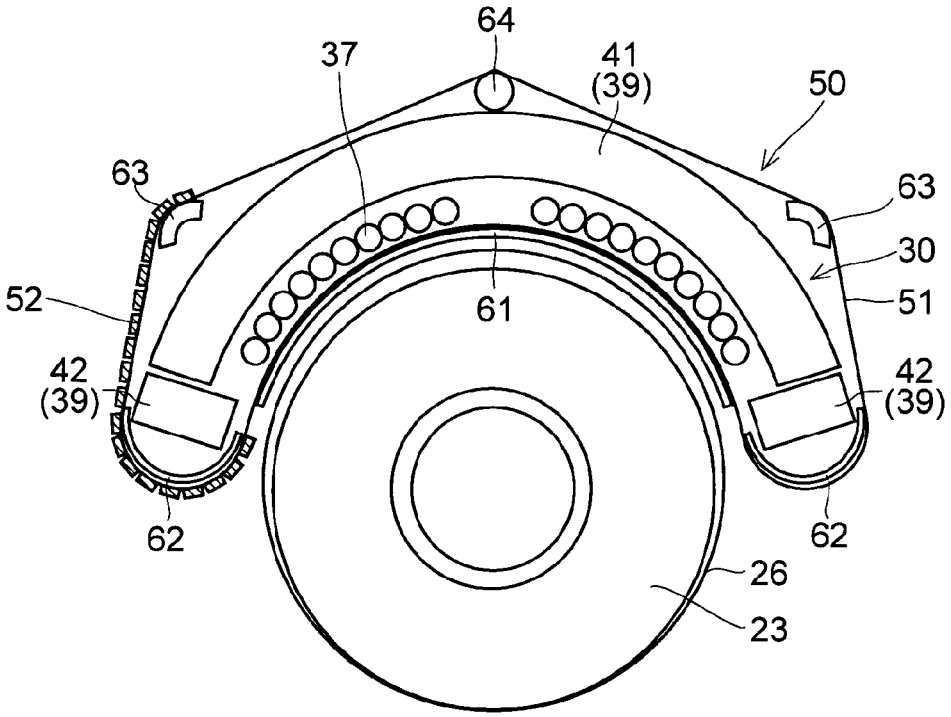
FIG. 8 is a sectional view schematically showing the structure of the induction heating part and its periphery in the fixing device according to the first embodiment of the present disclosure.
Figure 9:
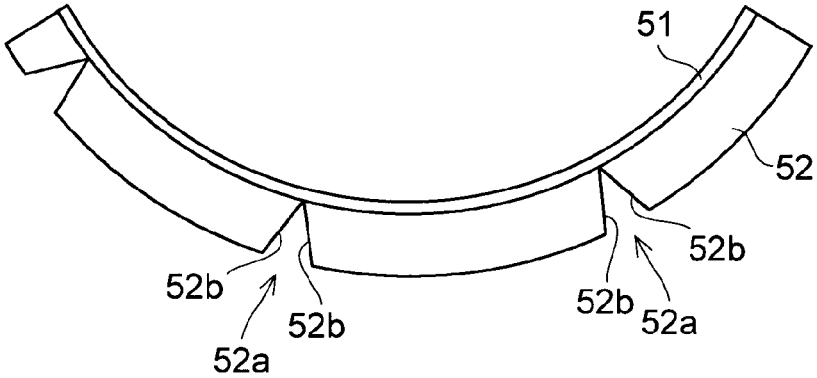
FIG. 9 is an enlarged sectional view schematically showing the structure of the magnetism shielding layer of the magnetism shielding member used in the fixing device according to the first embodiment of the present disclosure.

When the magnetism shielding member 50 passes through the guides 62, tension member 63 and drive roller 64, the magnetism shielding member 50 gets into a state illustrated in FIGS. 8 and 9. That is, the belt member 51 is bent and the gap parts 52*s* of the magnetism shielding layer 52 are further spread.

Figure 10:
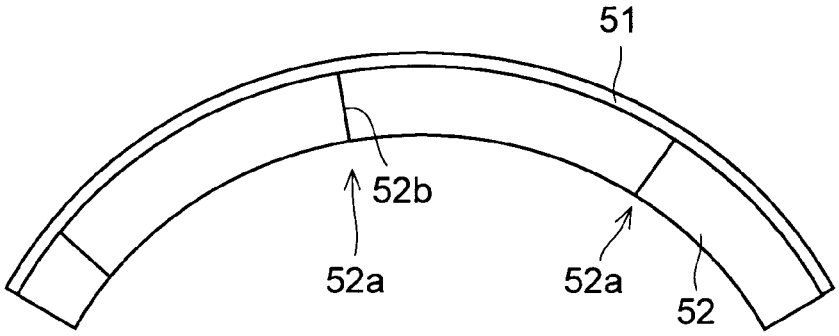
FIG. 10 is an enlarged sectional view schematically showing the structure of the magnetism shielding layer of the magnetism shielding member used in the fixing device according to the first embodiment of the present disclosure.

On the other hand, the magnetism shielding member 50 passes through the inside guide 61 (or stops at the inside guide 61), the magnetism shielding member 50 gets into a state illustrated in FIGS. 6 and 10. That is, in an area between the excitation coil 37 and heating belt 26, the belt member 51 is bent and the inner wall faces 52*b* of the gap part 52*a* of the magnetism shielding member 50 are brought into surface contact with each other (the gap part 52*a* is closed). In the present embodiment, the inner wall faces 52*b* of the gap part 52*a* are brought into surface contact with each other over the whole surfaces. According to this, it is possible to easily suppress the passage of the magnetic flux through the magnetism shielding layer 52.

Incidentally, a different fixing device from the present embodiment may include a metal sleeve, an induction coil generating a magnetic flux induction-heating the metal sleeve and a magnetic flux shielding means inserted between the metal sleeve and induction coil. In this different fixing device, when a small-sized sheet is used in fixing process, the magnetic flux shielding means is inserted from an end part in an axis direction of the metal sleeve between the metal sleeve and induction coil. According to this, the magnetic flux affecting a sheet not-passing region is cut off and heat generation of the sheet not-passing region by the metal sleeve is restrained. However, in this different fixing device, when the whole region is heated (when a large-sized sheet is used in the fixing process), it is necessary to move the magnetic flux shielding means to the outside in the axis direction of the metal sleeve. Therefore, it is considered that there is a problem that the different fixing device is enlarged in the axis direction of the metal sleeve.

Another different fixing device from the present embodiment may be configured so that an excitation coil and a magnetic core are located inside a fixing roller and a magnetic flux shielding member enclosing the excitation coil and magnetic core so as to pass between the excitation coil or the magnetic core and the fixing roller. The magnetic flux shielding member includes a flexible base layer and a metal shielding layer arranged in a predetermined area of the base layer and is stretched between a drive shaft and a tension shaft. In this other different fixing device, when a small-sized sheet is used in fixing process, the magnetic flux shielding member is rotated in a circumference direction, and accordingly, the shielding layer is inserted between the fixing roller and excitation coil. According to this, a magnetic flux affecting a sheet not-passing region is cut off and heat generation of the sheet not-passing region by the fixing roller is restrained.

A further different fixing device from the present embodiment may include a coil part generating a magnetic flux induction-heating a fixing belt, a magnetic core and a shielding member (a magnetic flux shielding member) enclosing the excitation coil and magnetic core so as to pass between the excitation coil and fixing belt and shielding the magnetic flux. The shielding member is an endless belt-like member made from a thin film metal and is stretched by a supporting shaft. In the shielding member, an opening part and a covered part shielding the magnetic flux are formed. In the further different fixing device, when the magnetic flux is shielded, the shielding member is rotated in a circumference direction, and accordingly, the covered part is inserted between the fixing belt and excitation coil. According to this, heat generation of the fixing belt by the fixing roller is restrained.

However, in the above-mentioned other different fixing device and further different fixing device, it is necessary to sufficiently increase a thickness of the shielding layer of the magnetic flux shielding member in order to sufficiently shield the magnetic flux. If the thickness of the shielding layer is increased, rigidity of the magnetic flux shielding member is hardened and the magnetic flux shielding member is hardly bent, and then, at a portion having a small curvature radius in a movement path of the magnetic flux shielding member, movement of the magnetic flux shielding member is inhibited. Therefore, it is considered that there is a problem that because it is necessary to enlarge diameters of the drive shaft, tension shaft and supporting shaft, as a result, it is difficult to downsize the device.

In the present embodiment, as mentioned above, the magnetism shielding member 50 is arranged so as to shield a part of the magnetic path. Moreover, the magnetism shielding member 50 includes the flexible belt member 51 driven to rotate and allowing the magnetic flux to pass through, and the non-magnetic metal magnetism shielding layer 52 arranged at the predetermined area in the surface of the belt member 51. According to this, when a small-sized sheet P is used in the fixing process, it is possible to drive the magnetism shielding member 50 to rotate in the circumference direction and to insert the magnetism shielding layer 52 in the magnetic path. In a situation of the magnetism shielding member 50 located at a position in which the magnetic path is shielded, the inner wall faces 52*b* of the gap part 52*a* of the magnetism shielding layer 52 are brought into contact with each other. According to this, it is possible to suppress the magnetic flux from passing through (leaking from) the gap part 52*a* of the magnetism shielding layer 52. Therefore, it is possible to suppress the magnetic flux affecting the sheet not-passing region Sa of the heating belt 26 and to restrain the generation of the heat and an excessive increase of temperature in the sheet not-passing region Sa of the heating belt 26.

In the magnetism shielding layer 52, the gap parts 52*a* extending in the width direction of the belt member 51 (the direction intersecting the circumference direction) are arranged at every predetermined pitch along the circumference direction of the belt member 51. According to this, because it is possible to facilitate the bend of the magnetism shielding layer 52 in the circumference direction of the belt member 51, it is possible to facilitate the bend of the magnetism shielding member 50. Therefore, because it is unnecessary to enlarge curvature radius of the guides 62, tension member 63 and drive roller 64 by which the magnetism shielding member 50 is suspended, it is possible to restrain enlargement of the device. According to the present disclosure, because it is unnecessary to move the magnetism shielding member 50 to the outside in the axis direction (the width direction) of heating belt 26, it is also possible to restrain enlargement of the fixing device 5 in the axis direction (the width direction) of heating belt 26.

As described above, the magnetism shielding member 50 encloses the excitation coil 37 and magnetic core 39 so as to pass between the excitation coil 37 and heating belt 26. In the area between the excitation coil 37 and heating belt 26, the inner wall faces 52*b* of the gap part 52*a* are brought into contact with each other. According to this, it is possible to easily shield the magnetic flux by the magnetism shielding member 50.

As described above, the gap part 52*a* is formed in a V-shaped sectional profile. According to this, because it is possible to easily bring the inner wall faces 52*b* of the gap part 52*a* into surface contact with each other, it is possible to easily suppress the magnetic flux from passing through (leaking from) the gap part 52*a* of the magnetism shielding layer 52. Moreover, because the inner wall faces 52*b* of the gap part 52*a* are brought into surface contact with each other over the whole surfaces, it is possible to shield almost all the magnetic flux.

As described above, at an end part in the width direction of the belt member 51 (the direction intersecting the circumference direction), the detected part 51*b* detected by the detecting sensor 71 is arranged. According to this, because it is possible to easily detect the rotation position of the belt member 51, it is possible to easily locate the magnetism shielding layer 52 at a suitable position.

Next, with reference to FIGS. 11 and 12, verification experimentation carried out in order to verify effect of arrangement of the magnetism shielding layer 52 will be described.

This verification experimentation was carried out by simulating with respect to a practical example 1 corresponding to the present embodiment and a comparative example 1 of not inserting the magnetism shielding layer 52 between the excitation coil 37 and heating belt 26.

In the practical example 1, in a situation of inserting the magnetism shielding layer 52 between the excitation coil 37 and heating belt 26, when the small-sized sheets P were continuously made passed, generated heat amount and temperature distribution in the heating belt 26 were obtained. In the practical example 1, the experimentation was carried out when the sheet passing region was determined to a width of approximately 200 mm and, at its outside, the magnetism shielding layer 52 with a width of approximately 70 mm was arranged.

In the comparative example 1, in another situation of not inserting the magnetism shielding layer 52 between the excitation coil 37 and heating belt 26, when the small-sized sheets P were continuously made passed, generated heat amount and temperature distribution in the heating belt 26 were determined. Other configurations of the comparative example 1 were similar to the practical example 1.

Figure 11:
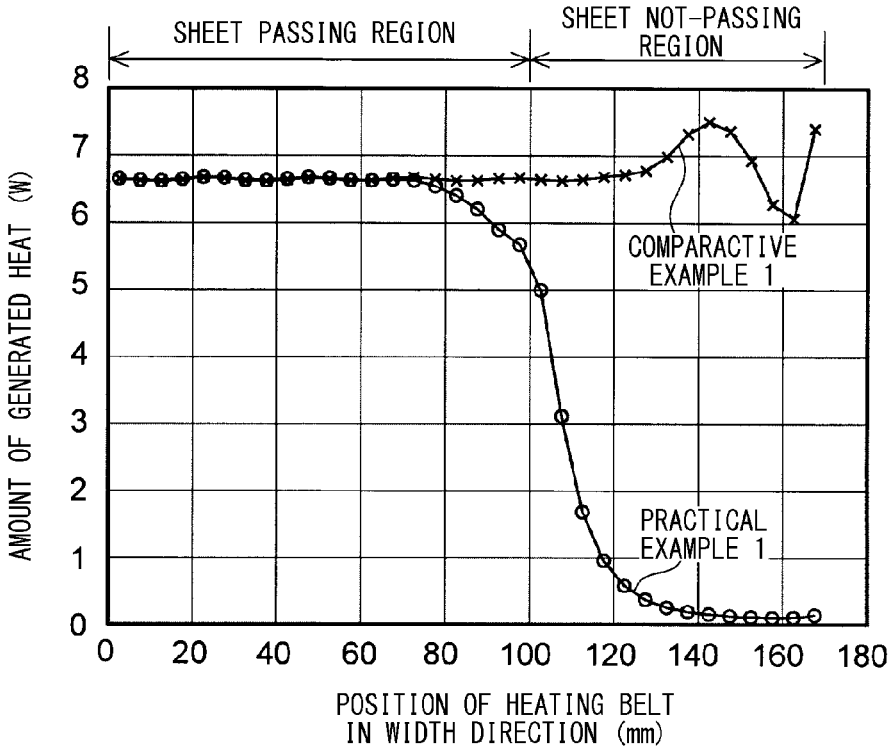
FIG. 11 is a graph plotting experimental results of verification experimentation, that relates to an amount of heat generated in a heating belt, carried out in order to verify effect of the magnetism shielding member used in the fixing device according to the first embodiment of the present disclosure.
Figure 12:
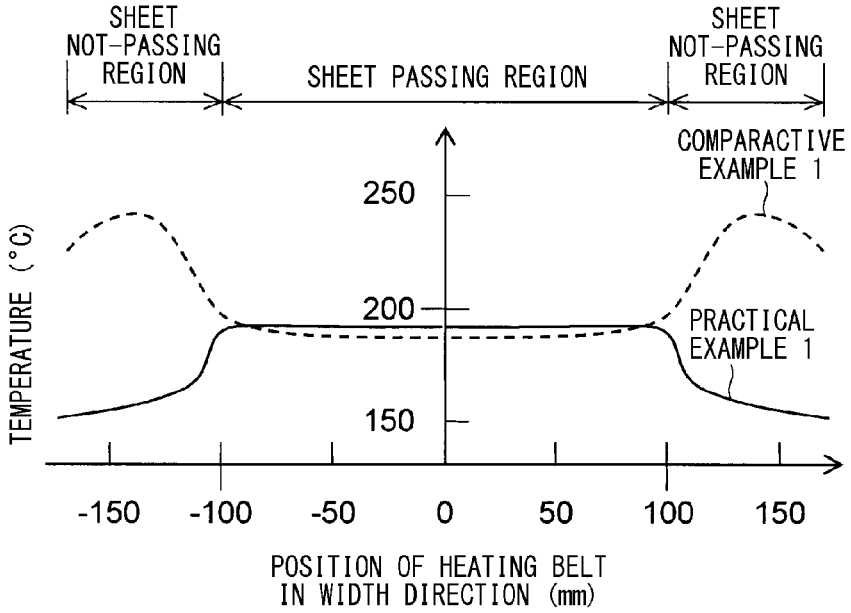
FIG. 12 is a graph plotting experimental results of verification experimentation, that relates to temperature distribution in the heating belt, carried out in order to verify effect of the magnetism shielding member used in the fixing device according to the first embodiment of the present disclosure.

Experimental results with relation to an amount of the heat generated in the heating belt 26 were plotted in FIG. 11 and experimental results with relation to temperature distribution in the heating belt 26 were plotted in FIG. 12. In FIG. 12, the experimental results were plotted with regard to the whole of the heating belt in the width direction, while, in FIG. 11, the experimental results were plotted with regard to right half of the heating belt 26 in the width direction. Therefore, in FIG. 11, a width of 100 mm in the sheet passing region was shown. This is the same as FIG. 16 mentioned below.

In the practical example 1, the amount of the heat generated in the sheet not-passing region Sa of the heating belt 26 could be decreased to approximately zero. In addition, the temperature in the sheet not-passing region Sa of the heating belt 26 could be lowered than the temperature of the sheet passing region (a portion except for the sheet not-passing region Sa) of the heating belt 26. By contrast, in the comparative example 1, the heat generated in the sheet not-passing region Sa of the heating belt 26 were the same degree as the sheet passing region. In addition, the temperature in the sheet not-passing region Sa of the heating belt 26 could be heightened than the temperature of the sheet passing region.

Consequently, it is possible to verify that, by inserting the magnetism shielding layer 52 between the excitation coil 37 and heating belt 26, the magnetic flux affecting the sheet not-passing region Sa is suppressed and the generation of the heat and the excessive increase of temperature in the sheet not-passing region Sa of the heating belt 26 is restrained.

Next, with reference to FIG. 13, a magnetism shielding member 50 used in the fixing device according to a second embodiment of the present disclosure will be described.

Figure 13:
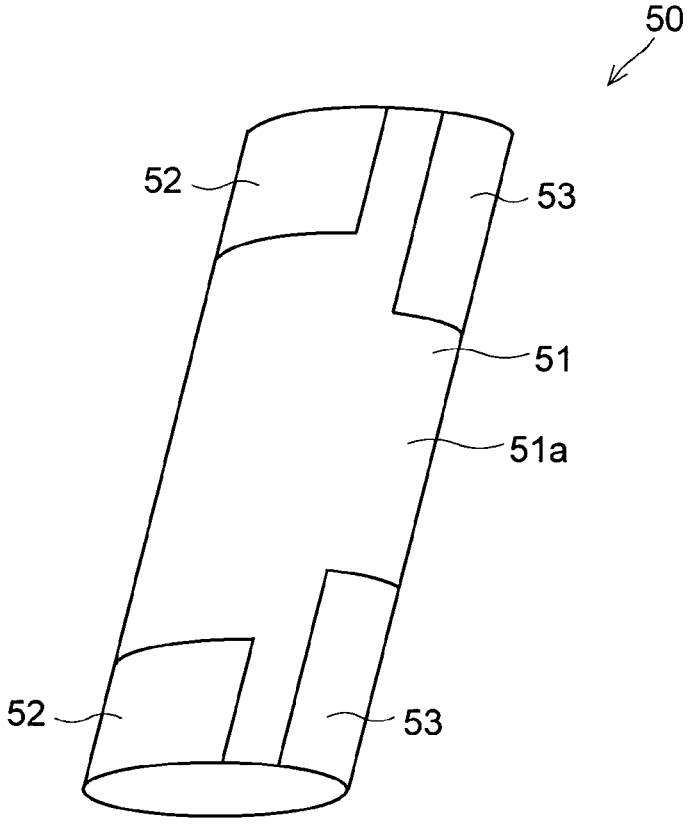
FIG. 13 is a perspective view schematically showing a structure of a magnetism shielding member used in a fixing device according to a second embodiment of the present disclosure.

In the second embodiment of the present disclosure, as shown in FIG. 13, the magnetism shielding member 50 includes a belt member 51, and magnetism shielding layers 52 and 53 arranged at predetermined areas in the surface of the belt member 51.

The belt member 51 may be formed to have a longer length in the circumference direction (an inner diameter in a cylinder state) than the first embodiment.

The magnetism shielding layer 53 is formed to have the same length in the circumference direction as the magnetism shielding layer 52, but to have a longer length in a width direction than the magnetism shielding layer 52. The magnetism shielding layers 52 and 53 are used for different purposes according to the width of the sheet P inserted in the nip part N. Other configurations of the magnetism shielding layer 53 are similar to the magnetism shielding layer 52. In the detected part 51*b* (omitted in FIG. 13), a reflection face (not shown) corresponding to the magnetism shielding layer 53 is formed.

In a case where a second sheet P having a further smaller width than the first sheet P is used in the fixing process, when the detecting sensor 71 detects the reflection face corresponding to the magnetism shielding layer 53, the magnetism shielding layer 53 of the magnetism shielding member 50 is inserted between the excitation coil 37 and heating belt 26, and the magnetism shielding member 50 stops. According to this, in the sheet not-passing region of the heating belt 26, the path of the magnetic flux generated by the excitation coil 37 is cut off between the heating belt 26 and magnetic core 39 by the magnetism shielding layer 53 of the magnetism shielding member 50, and the generation of the heat in the sheet not-passing region of the heating belt 26 is restrained.

Other configurations of the second embodiment are similar to the first embodiment.

In the present embodiment, as mentioned above, the magnetism shielding layers 52 and 53 are arranged along the circumference direction of the belt member 51 and the magnetism shielding layers 52 and 53 have the different lengths in the width direction (the direction intersecting the circumference direction) from each other. According to this, since it is possible to change the size of the magnetism shielding layer according to sheet size, it is possible to effectively restrain the excessive increase of temperature in the sheet not-passing region of the heating belt 26.

Other effects of the second embodiment are similar to the first embodiment.

Next, with reference to FIGS. 14-17, a magnetism shielding layer 54 used in the fixing device according to a third embodiment of the present disclosure will be described.

Figure 14:
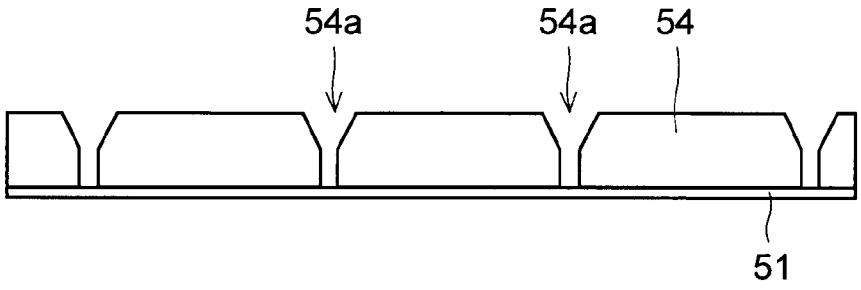
FIG. 14 is an enlarged sectional view schematically showing a structure of a magnetism shielding layer used in a fixing device according to a third embodiment of the present disclosure.

In the third embodiment of the present disclosure, as shown in FIG. 14, in the magnetism shielding layer 54, gap parts 54*a* formed in a V-shaped sectional profile are arranged. According to this, it is possible to facilitate the bend of the magnetism shielding layer 54 in the circumference direction.

Figure 15:
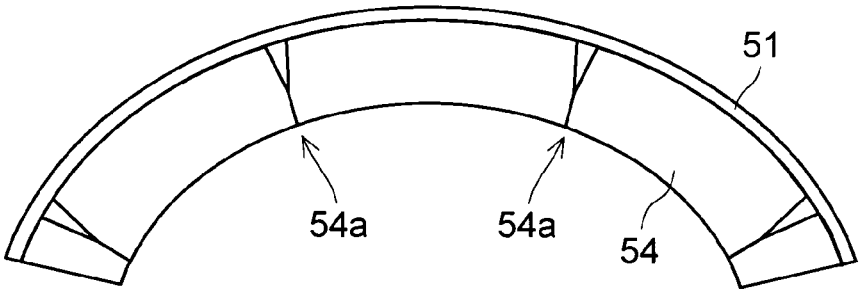
FIG. 15 is an enlarged sectional view schematically showing the structure of the magnetism shielding layer used in the fixing device according to the third embodiment of the present disclosure.

In the present embodiment, when the magnetism shielding member 50 passes through the inside guide 61 (or stops at the inside guide 61), the magnetism shielding member 50 gets into a state illustrated in FIG. 15. That is, in the area between the excitation coil 37 and heating belt 26, respective portions (portions far from the belt member 51) of inner wall faces of the gap part 54*a* of the magnetism shielding member 50 are brought into surface contact with each other. According to this, since a thickness of the magnetism shielding layer 54 is thinned in the gap part 54*a*, it is possible to make a part of the magnetic flux passed through the magnetism shielding layer 54.

Figure 16:
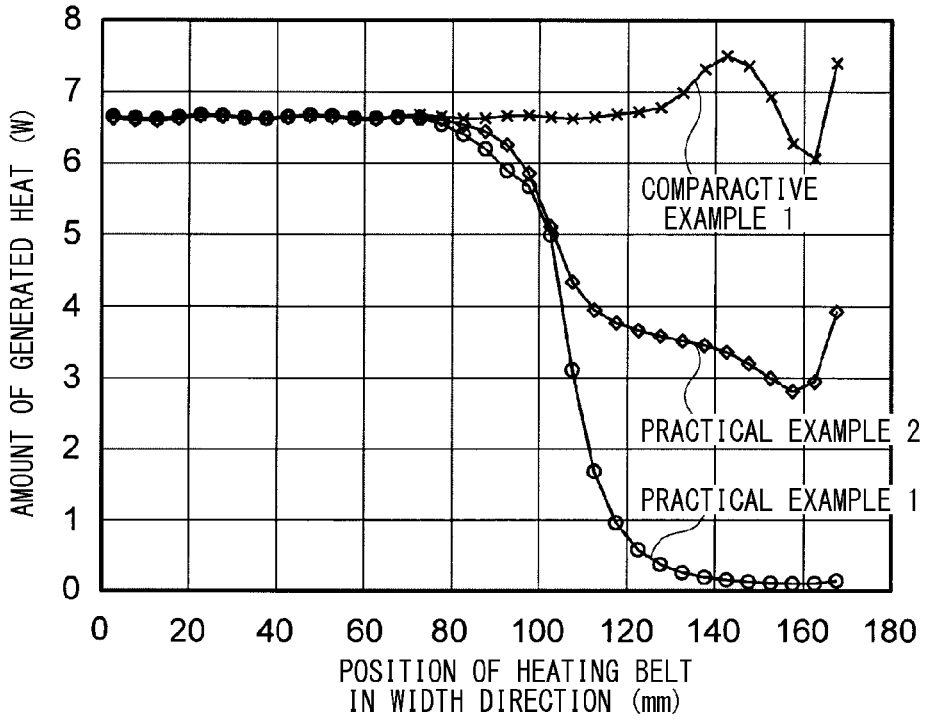
FIG. 16 is a graph plotting experimental results of verification experimentation, that relates to an amount of heat generated in a heating belt, carried out in order to verify effect of the magnetism shielding layer used in the fixing device according to the third embodiment of the present disclosure.

When the magnetism shielding layer 54 was used, results of verification experimentation with relation to an amount of the heat generated in the heating belt 26 in a similar way to the above mentioned first embodiment were plotted in FIG. 16. As a result, in a practical example 2 using the magnetism shielding layer 54 in the fixing device of the present embodiment, the amount of the heat generated in the sheet not-passing region Sa of the heating belt 26 were increased in comparison with the practical example 1 and decreased in comparison with the comparative example 1. According to this, it is possible to restrain excessive lowering of the temperature in the sheet not-passing region Sa of the heating belt 26.

Figure 17:
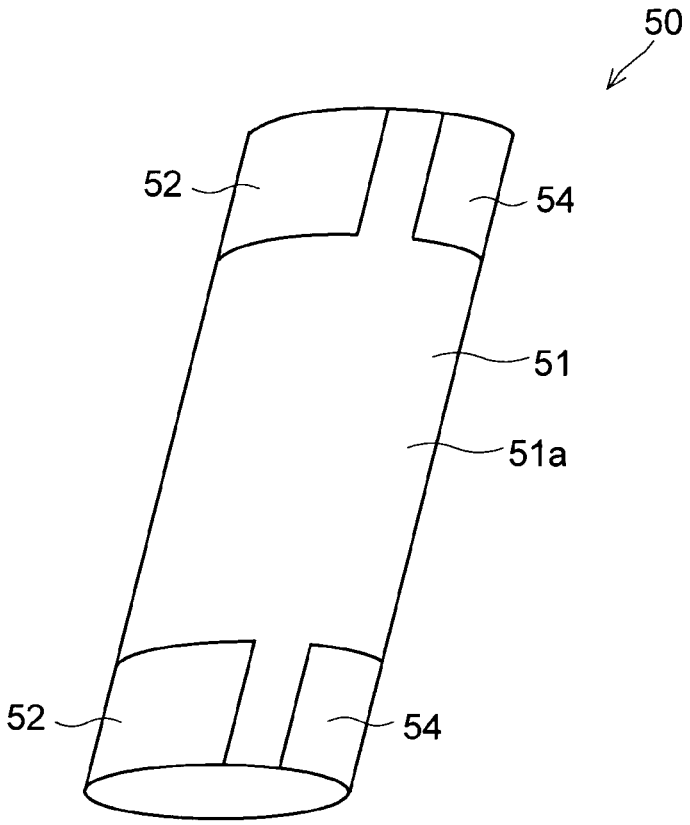
FIG. 17 is a perspective view schematically showing an example of a magnetism shielding member used in the fixing device according to the third embodiment of the present disclosure.

In the belt member 51, both the magnetism shielding layer 52 and magnetism shielding layer 54 may be arranged. In such a case, as shown in FIG. 17, the magnetism shielding layer 52 and magnetism shielding layer 54 may be located in a row in the circumference direction of the heating belt 26.

According to such a configuration, when the detecting sensor 71 detects the reflection face corresponding to the magnetism shielding layer 52 or the magnetism shielding layer 54, a portion inserted between the excitation coil 37 and heating belt 26 is switched between the magnetism shielding layer 52 and magnetism shielding layer 54. According to this, it is possible to maintain the temperature in the sheet not-passing region Sa of the heating belt 26 within a predetermined range.

Other configurations of the third embodiment are similar to the first embodiment.

In the present embodiment, as mentioned above, the V-shaped gap part 52*a* or the Y-shaped gap part 54*a* is arranged in the magnetism shielding layer. That is, the gap part having the inner wall faces with different inclined angles against the surface of the belt member 51 from each other or the gap part having the inner wall faces with different widths in the circumference direction from each other is provided in the magnetism shielding layer. According to this, since it is possible to easily determine the contact area of the inner wall faces of the gap part to a predetermined size, it is possible to easily set the rate of shielding the magnetic flux to a predetermined magnitude.

Other effects of the third embodiment are similar to the first embodiment.

Figure 18:
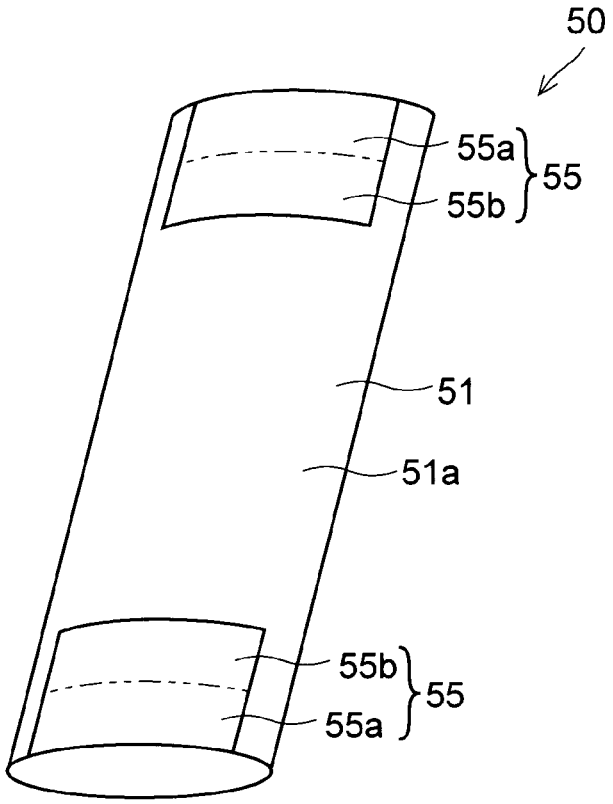
FIG. 18 is a perspective view schematically showing a structure of a magnetism shielding member used in a fixing device according to a fourth embodiment of the present disclosure.

Next, a fourth embodiment of the present disclosure will be described. In a magnetism shielding member 50 used in the fixing device according to the fourth embodiment of the present disclosure, as shown in FIG. 18, a magnetism shielding layer 55 is formed so that a portion 55*a* having the V-shaped gap part 52*a* and a portion 55*b* having the Y-shaped gap part 54*a* is located in a row in the width direction. According to this, it is possible to lower the temperature of the sheet not-passing region Sa of the heating belt 26 gradually to the outside in the width direction.

Other configurations and effects of the fourth embodiment are similar to the third embodiment.

The present disclosed embodiments should be understood as technical illustration, but not as description restricting the disclosure. The extent of the disclosure may be based on the claims, but not the description of the embodiments, and furthermore, may include various changes or modifications within the meanings and extent equivalent the claims.

For example, although examples applying the disclosure to a monochrome image forming apparatus were described, the disclosure is not restricted by this, and may be applied, needless to say, to a color image forming apparatus.

In the above-described embodiments, although examples arranging one kind or two kinds of magnetism shielding layer(s) in the belt member were described, the disclosure is not restricted by this, and may arrange three or more magnetism shielding layers in the belt member.

In the above-described embodiments, although examples of the fixing device 5 in which the heating belt 26 is stretched by the fixing roller 23 were described, the disclosure is not restricted by this, and may be applied to a fixing device 5 in which the heating belt 26 is suspended by the fixing roller 23 and a suspension roller. Alternatively, the disclosure may be applied to a fixing device 5 including a pressing roller 19 being in pressure-contact state with the external circumference face of the heating belt 26 in contact state and a pressuring member arranged at the internal circumference face's side of the heating belt 26 and bringing the sheet P and heating belt 26 in pressure-contact state with each other. Further, the disclosure may be applied to various electromagnetic induction heating type fixing device, such as a fixing device 5 including a pressing roller 19 and a heating roller brought in pressure-contact state with the pressing roller 19; the heating roller containing an induction heat generation layer and being located facing to an induction heating part.

The disclosure may be applied to a fixing device having a magnetism shielding member not enclosing an excitation coil and a magnetic core, or a fixing device having a magnetic core and a magnetism shielding member located inside a fixing roller.

Figure 19:
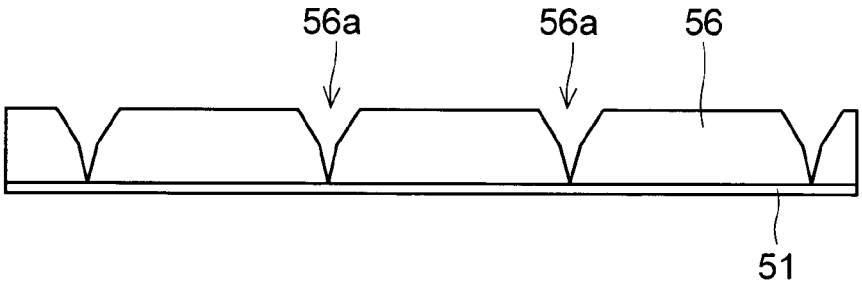
FIG. 19 is an enlarged sectional view schematically showing a structure of a magnetism shielding layer used in a fixing device of a modified example of the present disclosure.
Figure 20:
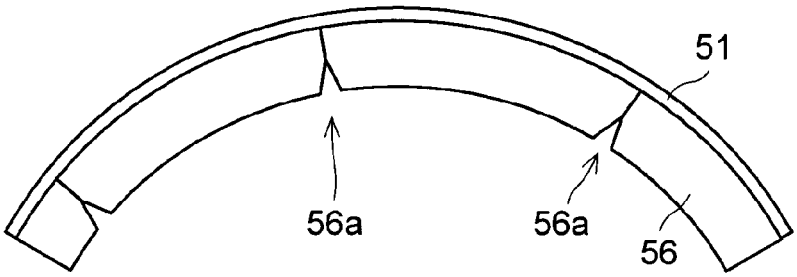
FIG. 20 is an enlarged sectional view schematically showing a structure of a magnetism shielding layer used in a fixing device of a modified example of the present disclosure.

The sectional profile of the gap part of the magnetism shielding layer is not restricted by those of the above-described embodiments. For example, the sectional profile may be formed as a magnetism shielding layer 56 according to a modified example of the present disclosure shown in FIG. 19. That is, the magnetism shielding layer 56 is configured so that a portion at the belt member 51's side of the gap part 56*a* is formed in a V-shaped sectional profile and a portion far from the belt member 51 of the gap part 56*a* is formed in a further spread sectional profile. According to such a configuration, as shown in FIG. 20, in the area between the excitation coil 37 and heating belt 26, respective portions at the belt member 51's side of inner wall faces of the gap part 56*a* of the magnetism shielding member 50 can be brought into surface contact with each other. The shape of the gap part (the inclined angle of the inner wall face of the gap part against the surface of the belt member, the width of the gap part in the circumference direction and the others) is not restricted by the above-described embodiments and modified example, but may be suitably determined in accordance with desired magnetism shielding properties. Incidentally, in a case where several magnetism shielding layers having respective gap parts formed in different shapes from each other are arranged as the third and fourth embodiments, the several magnetism shielding layers may configured to have the respective gap parts formed in different shapes from each other with respect to one of the inclined angle of the inner wall face of the gap part against the surface of the belt member and the width of the gap part in the circumference direction.

The above-described embodiments were described about examples forming the gap part by etching the magnetism shielding layer adhered on the belt member 51. However, the disclosure is not restricted by this, but may be configured so as to stick a magnetism shielding layer having a previously formed gap part to the belt member 51.

Further configurations reached by suitably combining the above-described embodiments and modified example are also included within the technical extent of the disclosure.

What is claimed is:

1. A fixing device comprising:

a pressing member;

a heating member pressed into contact with the pressing member to form a nip part;

an excitation coil for generating a magnetic flux and provide a magnetic flux induction-heat to the heating member;

a magnetic core located at an opposite side from the heating member across the excitation coil and configured to provide a magnetic path passing through the excitation coil and heating member; and a magnetism shielding member arranged so as to shield a part of the magnetic path, and configured to include a flexible endless belt member driven to rotate and allowing the magnetic flux to pass through, and a non-magnetic metal magnetism shielding layer arranged at a predetermined area in a surface of the belt member, and further, configured so that, in the magnetism shielding layer, gap parts extending in a width direction of the belt member are arranged at equal intervals in a circumference direction of the belt member, each gap part having opposite inner wall faces extending in the width direction, wherein, in a situation of the magnetism shielding member located at a position in which the magnetic path is shielded, the belt member is bent toward a side of the magnetism shielding member and the opposite inner wall faces of at least one gap part of the magnetism shielding layer are at least partly brought into contact with each other, and a several number of magnetism shielding layers is configured to have the respective gap parts formed in different shapes from each other with respect to at least one of an inclined angle of the inner wall face of each gap part against the surface of the belt member and a width of each gap part in the circumference direction.

2. The fixing device according to claim 1, wherein the magnetism shielding member encloses the excitation coil and magnetic core so as to pass between the excitation coil and heating belt, the belt member is driven to rotate around the excitation coil and magnetic core, and in an area between the excitation coil and heating belt, the belt member is bent and the inner wall faces of the gap part of the magnetism shielding layer are brought into contact with each other.

3. The fixing device according to claim 1, wherein the sectional profile of each gap part is formed in a V-shape or a Y-shape.

4. The fixing device according to claim 1, wherein a several number of the magnetism shielding layers are arranged along the circumference direction of the belt member, and the several number of the magnetism shielding layers have the different lengths in the width direction from each other.

5. The fixing device according to claim 1 further comprising:

a position detecting member detecting a rotational position of the belt member, wherein the belt member includes a detected part detected by the position detecting member, the detected part is arranged at an end part in the width direction.

6. The fixing device according to claim 5, wherein the detected part includes reflection faces at positions corresponding to the magnetism shielding layer and a magnetic region, and the position detecting member includes a light projecting part irradiating a light to the reflection face and a light receiving part receiving a reflected light from the reflection face.

7. An image forming apparatus comprising:

an image forming part; and a fixing device, wherein the fixing device includes:

a pressing member;

a heating member pressed into contact with the pressing member to form a nip part;

an excitation coil for generating a magnetic flux and provide a magnetic flux induction-heat to the heating member;

a magnetic core located at an opposite side from the heating member across the excitation coil and configured to provide a magnetic path passing through the excitation coil and heating member; and a magnetism shielding member arranged so as to shield a part of the magnetic path, and configured to include a flexible endless belt member driven to rotate and allowing the magnetic flux to pass through, and a non-magnetic metal magnetism shielding layer arranged at a predetermined area in a surface of the belt member, and further, configured so that, in the magnetism shielding layer, gap parts extending in a width direction of the belt member are arranged at equal intervals in a circumference direction of the belt member, each gap part having opposite inner wall faces extending in the width direction, and in a situation of the magnetism shielding member located at a position in which the magnetic path is shielded, the belt member is bent toward a side of the magnetism shielding member and of the opposite inner wall faces of at least one gap part of the magnetism shielding layer are at least partly brought into contact with each other, and a several number of magnetism shielding layers is configured to have the respective gap parts formed in different shapes from each other with respect to at least one of an inclined angle of the inner wall face of each gap part against the surface of the belt member and a width of each gap part in the circumference direction.

8. The image forming apparatus according to claim 7, wherein the magnetism shielding member encloses the excitation coil and magnetic core so as to pass between the excitation coil and heating belt, the belt member is driven to rotate around the excitation coil and magnetic core, and in an area between the excitation coil and heating belt, the belt member is bent and the inner wall faces of the gap part of the magnetism shielding layer are brought into contact with each other.

9. The image forming apparatus according to claim 7, wherein the sectional profile of each gap part is formed in a V-shape or a Y-shape.

10. The image forming apparatus according to claim 7, wherein a several number of the magnetism shielding layers are arranged along the circumference direction of the belt member, and the several number of the magnetism shielding layers have the different lengths in the width direction from each other.

11. The image forming apparatus according to claim 7, wherein the fixing device further includes:

a position detecting member detecting a rotational position of the belt member, wherein the belt member includes a detected part detected by the position detecting member, the detected part is arranged at an end part in the width direction.

12. The image forming apparatus according to claim 11, wherein the detected part includes reflection faces at positions corresponding to the magnetism shielding layer and a magnetic region, and the position detecting member includes a light projecting part irradiating a light to the reflection face and a light receiving part receiving a reflected light from the reflection face.

* * * * *